US006024260A

United States Patent [19]

Zacharias et al.

[11] Patent Number: 6,024,260

[45] Date of Patent: Feb. 15, 2000

[54] TUNDISH IMPACT PAD

[75] Inventors: Donald R. Zacharias, Parma; Bryce R. Jardine, Brunswick, both of Ohio

[73] Assignee: Foseco International Limited, Wiltshire, United Kingdom

[21] Appl. No.: 09/029,342

[22] PCT Filed: Jul. 8, 1996

[86] PCT No.: PCT/GB96/01625

§ 371 Date: Feb. 27, 1998

§ 102(e) Date: Feb. 27, 1998

[87] PCT Pub. No.: WO97/07915

PCT Pub. Date: Mar. 6, 1997

[30] Foreign Application Priority Data

Aug. 30, 1995 [GB] United Kingdom ..... 9517633

[51] Int. Cl.[7] ..... C22B 41/08

[52] U.S. Cl. ..... 222/594; 266/45; 266/275; 264/314

[58] Field of Search ..... 266/275, 236, 266/45; 222/590, 594; 264/314

[56] References Cited

U.S. PATENT DOCUMENTS

| | | | |
|---|---|---|---|
| 1,177,240 | 3/1916 | Gates | 264/314 |
| 3,470,284 | 9/1969 | Hartmann | 264/314 |
| 5,169,591 | 12/1992 | Schmidt . | |
| 5,358,551 | 10/1994 | Saylor . | |
| 5,518,153 | 5/1996 | Zacharias et al. . | |

FOREIGN PATENT DOCUMENTS

| | | |
|---|---|---|
| 41 467 | 2/1887 | Germany . |
| 22 24 482 | 12/1973 | Germany . |

OTHER PUBLICATIONS

Isenberg–O'Loughlin, "Dishing It Out, The Latest in Tundish Utensils and High–Tech Tableware" Metalproducing, No. 33, Feb. 1996.

*Primary Examiner*—Scott Kastler
*Attorney, Agent, or Firm*—Nixon & Vanderhye P.C.

[57] ABSTRACT

The impact pad (10) comprises a body of refractory material capable of withstanding contact with molten steel in a tundish, the body comprising a base (12) having an impact surface (13), an outer sidewall (14) extending upwardly from the impact surface (13), an annular portion (15) providing a top surface (16) substantially parallel to the impact surface (13) and connected to the sidewall (14) and defining an opening (11) into the pad, the lower face (17) of the annular portion (15), the inner face (18) of the sidewall (14) and the upper surface (19) of the base (12) adjacent the sidewall (14) together providing a continuous curved surface, which surface adjacent its lower end defines a trough (20) around the perimeter of the impact surface (13) of the base (12).

23 Claims, 3 Drawing Sheets

TUNDISH IMPACT PAD

This invention relates to a tundish impact pad, i.e. a pad of erosion resistant material positioned on the floor of a tundish to receive the incoming stream of molten metal poured into the tundish from a ladle.

U.S. Pat. No. 5,169,591 shows an impact pad for a tundish for continuous casting of steel that is a significant advance over the art. The impact pad, as illustrated and described in that patent, can substantially eliminate surface turbulence in a continuous casting tundish as well as providing other advantages including minimisation of slag entrainment within the liquid steel bath in the tundish, prevention of the break-up of tundish flux cover and reoxidation of the liquid steel bath and ensuring a proper flow path of the steel within the tundish.

The particular design of the impact pad actually illustrated in the drawings of the U.S. Pat. No. 5,169,591 may be ideally suited for certain combinations of tundish design and casting conditions, while for other combinations of tundish design and casting conditions a modification thereof is more desirable. It has been found, therefore, according to our U.S. Pat. No. 5,518,153, that particularly for combinations of tundish design and casting conditions where the additional benefits of increased inclusion flotation or reduced volume of mixed steel chemistry upon grade changes are sought, it is desirable to provide an impact pad having an annular (closed) configuration. It has also been found, according to that invention, however, that the annular configuration must be non-uniform. That is, the opening provided in the impact pad into which the liquid steel flows must be longer along the long axis of the tundish than it is along the short axis. The preferred configuration of the impact pad is rectangular, although oval or other polygon shapes may be provided as long as they are non-uniform (e.g. not circular or square).

Thus, in U.S. Pat. No. 5,518,153, there is described a tundish impact pad formed from a refractory composition capable of withstanding continuous contact with molten metal, said pad comprising a base having an impact surface and an endless outer side wall extending upwardly therefrom and fully enclosing an interior space having an upper opening for receiving a stream of said molten metal, said outer wall including an annular inner surface having at least a first portion extending inwardly and upwardly toward said opening, whereby, when a downwardly directed stream of molten metal from a location disposed above said impact pad strikes said impact surface, said stream is directed outwardly toward said annular inner surface and then redirected upwardly and inwardly toward the incoming molten metal stream.

More specifically, the impact pad described in one embodiment in that patent has an annular inner surface which further includes a second portion extending outwardly and upwardly from said impact surface towards said first portion of the annular inner surface. One or both of the first and second portions are of concave annular shape and the first and second portions may be continuous. Thus, the annular inner surface may be semi-circular about an axis substantially parallel to the impact surface thereby providing a sidewall with a semi-circular interior face around the entire periphery of the impact surface. This pad, therefore, has no interior corners so as to avoid the possibility of molten steel collecting in such corners and eroding the refractory material of the impact pad.

In U.S. Pat. No. 5,358,551 is disclosed an impact pad for a tundish, the pad having a continuous upstanding sidewall surrounding a flat impact surface, the sidewall having an inclined or curved inner surface forming an annular portion extending inwardly and upwardly to the opening into the pad.

In DE-A-2224482 is disclosed a tundish whose floor beneath a casting spout has an upwardly pointed, raised portion, conical in section, with a trough in the floor at each side of and adjacent the base of the conical section. This construction is intended to remove alumina inclusions from aluminium—killed steels.

It is an object of the present invention to provide a further improvement in the design of the aforesaid impact pads and to provide a method of making such an improved impact pad.

Accordingly, in one aspect the invention provides a tundish impact pad comprising a body of refractory material capable of withstanding contact with molten steel in a tundish, the body comprising a base having an impact surface, an outer sidewall extending upwardly from the impact surface, an annular portion providing a top surface substantially parallel to the impact surface and connected to the sidewall and defining an opening into the pad, the lower face of the annular portion, the inner face of the sidewall and the upper surface of the base adjacent the sidewall together providing a continuous curved surface, which surface adjacent its lower end defines a trough around the perimeter of the impact surface of the base.

Molten steel entering the tundish contacts the impact surface and flows outwardly to contact the continuous curved surface where it is turned inwardly and upwardly to flow out of the opening.

The sidewall preferably extends continuously around the impact surface. However, this is not essential and the sidewall may be formed in two or more discrete sections with one or more gaps respectively between them.

The opening defined by the annular portion, and through which the molten steel is poured to reach the impact surface, may be of uniform dimensions but preferably is non-uniform, i.e. it preferably has a long dimension and a short dimension perpendicular to the long dimension. Thus, it may be of rectangular or elipsoidal shape.

In another aspect the invention provides a method of making a tundish impact pad of the invention as defined above, in which a mould is provided to define a base portion of the pad having an impact surface a sidewall surrounding the base and an annular portion to provide a top surface of the pad parallel to its impact surface, an annular inflatable bladder is positioned in the mould and is inflated to define a mould cavity having the base portion above the bladder and the sidewall portion between the exterior of the bladder and the sidewalls of the mould, a settable refractory composition is introduced to fill the mould cavity and the bladder is deflated and removed after the composition has set.

In a third aspect the invention provides an apparatus for the manufacture of a tundish impact pad, the pad having a base having an impact surface, a sidewall surrounding the base and an annular portion to provide a top surface of the pad parallel to the impact surface, the apparatus comprising a mould having a base and upstanding sidewalls, and characterised by an annular bladder positionable in the mould and inflatable to define a mould cavity in which the base portion of the pad is above the bladder and the sidewall portion of the pad is between the exterior of the bladder and the sidewall of the mould.

In a fourth aspect the invention provides an inflatable bladder for use in the aforesaid method or apparatus, the bladder being annular and having a configuration in plan view which is non-uniform in that it has a long dimension and a short dimension perpendicular to the long dimension.

Preferably the bladder is positioned around a mould core and the base of the impact pad is formed above the core with the impact surface being defined by the upper surface of the core.

Preferably the bladder is attached to the core via a connector to allow passage of gas and inflation gas, usually air, is passed through suitable passages through the core and via the connector to inflate the bladder. A plurality of connectors may be used, e.g. one on each side of a rectangular core where the bladder and the final impact pad are of rectangular plan form.

The core preferably has edges around which the bladder is fitted, the edges being concave to embrace a portion of the external circumference of the bladder. The uninflated bladder, when attached to the core by the aforesaid connector(s), may conveniently be positioned closely adjacent the core by application of a vacuum through the passages through the core.

The bladder may be of rectangular plan form where a rectangular impact pad is required or, for example, of oval plan form.

The curvature of the continuous curved surface defined by the lower face of the annular portion of the impact pad, its inner sidewall face and the upper surface of the base adjacent the sidewall is not necessarily of the same radius throughout.

The mould core preferably is positioned on a centrally-disposed pad on the base of the mould such that the inflated bladder overhangs the perimeter of the pad and the cavity for the annular top portion of the impact pad is defined between the sidewalls and base of the mould, a portion of the bladder surface and the sides of the pad.

The impact pads of the present invention are formed from a castable refractory composition which is capable of withstanding continuous contact with molten metal, in particular, molten steel such as is used in continuous casting operations. Usually a standard medium-to-high alumina refractory with an alumina content in the range of about 55 to 85% is desirable. Where a basic refractory is preferred because of steel chemistry, it is preferred that a magnesia-based refractory composition be utilised, with MgO in the range of about 58 to 93%.

The invention is particularly useful in providing improved residence time distribution parameters in the poured molten steel.

BRIEF DESCRIPTION OF THE DRAWINGS

The invention is now described by way of example only with reference to the accompanying drawings in which:

In FIGS. 1, 2 and 3, impact pad 10 is of generally rectangular plan form to provide the desired non-uniform opening 11. Base 12 of the pad has an impact surface 13 to receive the molten steel. An endless sidewall 14 extends around the base, extending upwardly therefrom. An annular portion 15 extends from the sidewall and provides an upper surface 16 parallel to the impact surface 13. The lower face 17 of the annular portion 15, the inner surface 18 of the sidewall 14 and the upper surface 19 of the base 12 adjacent the sidewall provide a continuous curved surface which, adjacent its lower end, defines a trough 20 around the perimeter of impact surface 13 of base 12. Pairs of lifting hooks 21 are embedded in two opposed sidewalls 14 during the casting of the pad to provide lifting means.

FIG. 4 shows a mould 30 in which the impact pad can be cast. It comprises a base 31 and upstanding sidewalls 32. A rectangular pad 33 sits on base 31 and is of smaller dimensions than the base 31 whereby a channel 34 extends around the perimeter of the base.

In FIG. 5 an aluminium core 40 has been positioned on pad 33 and an inflatable bladder 41, shown in inflated form, is attached around the concave rim 42 of the aluminium core. Passages 43 through the aluminium core 40 and pad 33 communicate via connectors 44 to the interior of the bladder whereby it may be inflated after positioning in the mould.

Figure 1:
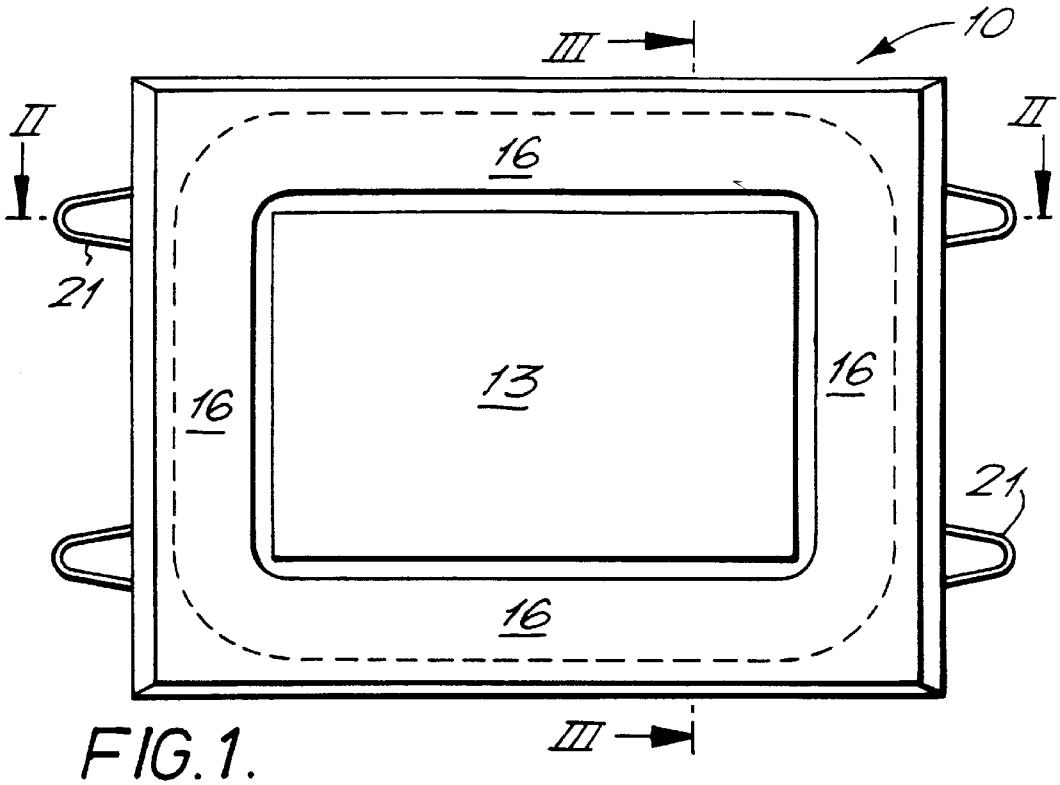
FIG. 1 is a plan view of a tundish impact pad of the invention.
Figure 2:
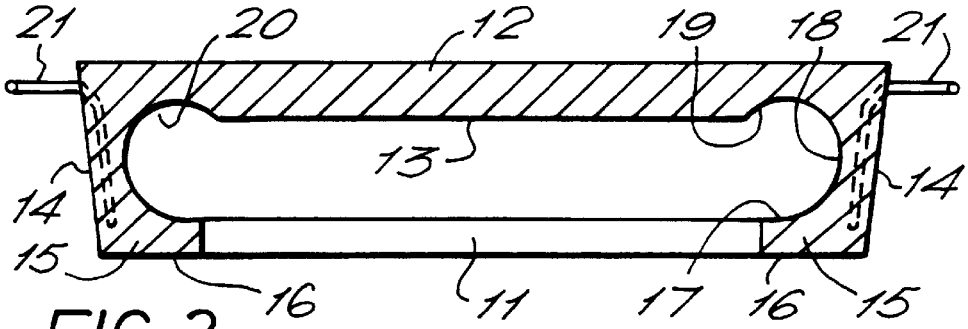
FIG. 2 is a section along line II—II of FIG. 1.
Figure 3:
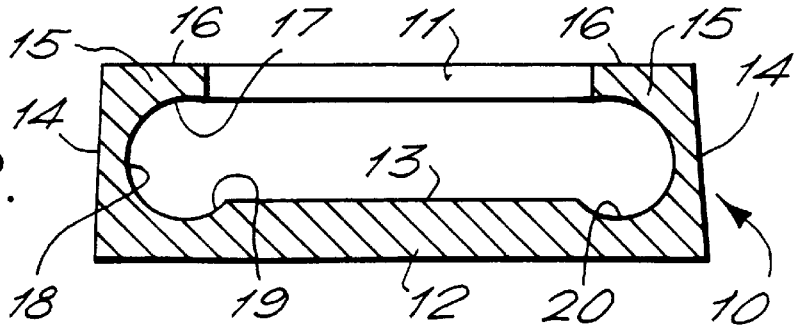
FIG. 3 is a section along line III—III of FIG. 1.
Figure 4:
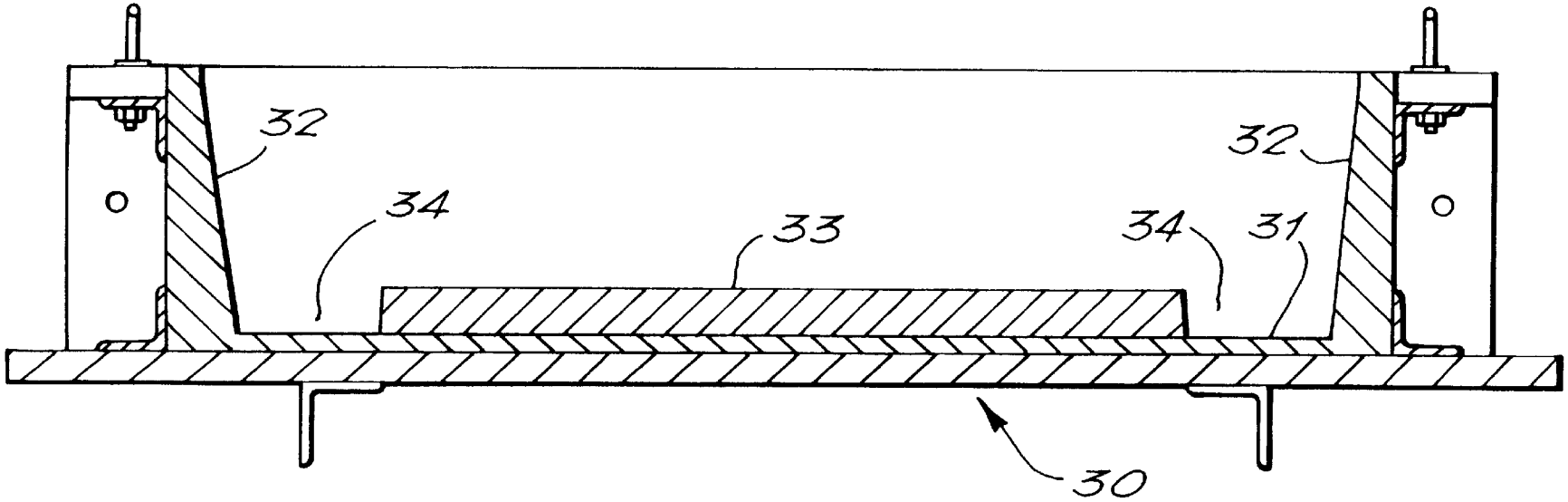
FIG. 4 is a section through a mould for use in the method of the invention prior to the insertion of the mould core and bladder.
Figure 5:
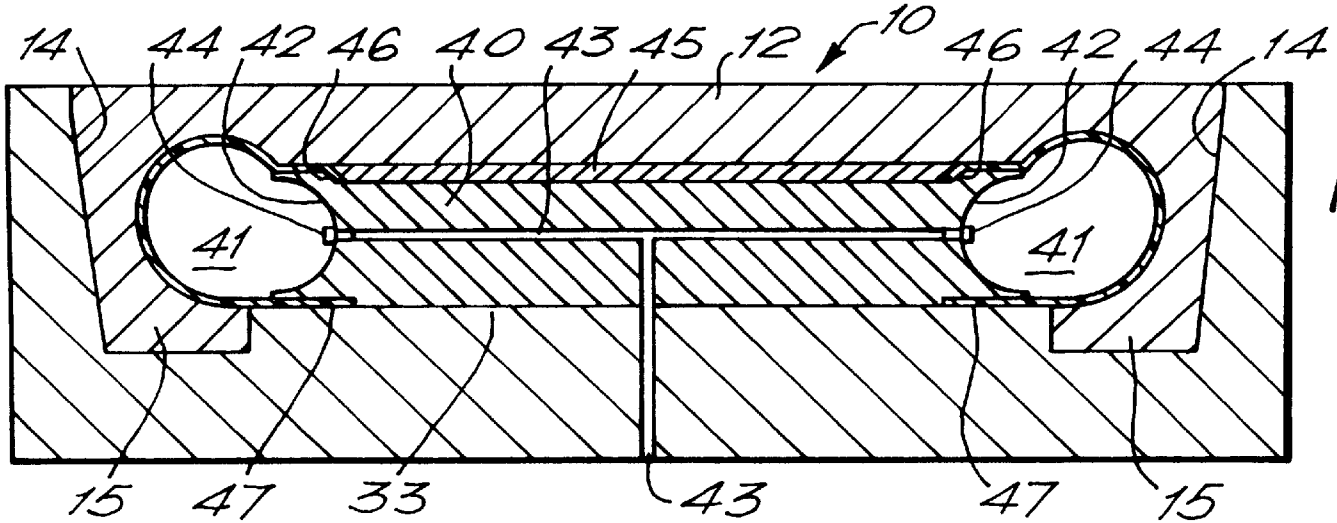
FIG. 5 is a similar section to FIG. 4 but showing a core and inflated bladder in the mould and the impact pad cast in the mould cavity.

An aluminium plate 45 sits in a corresponding recess in the top of core 40 and traps a length 46 of the bladder material between the plate and core to hold the bladder in the desired position. Similarly a length 47 of bladder material is trapped between the lower edges of the core and the upper face of pad 33.

As shown the bladder overhangs the channel 34 of the mould and the cavity defined between the core and inflated bladder and the walls, floor and pad of the mould is filled with a settable refractory composition to form the impact pad 10.

Figure 6:
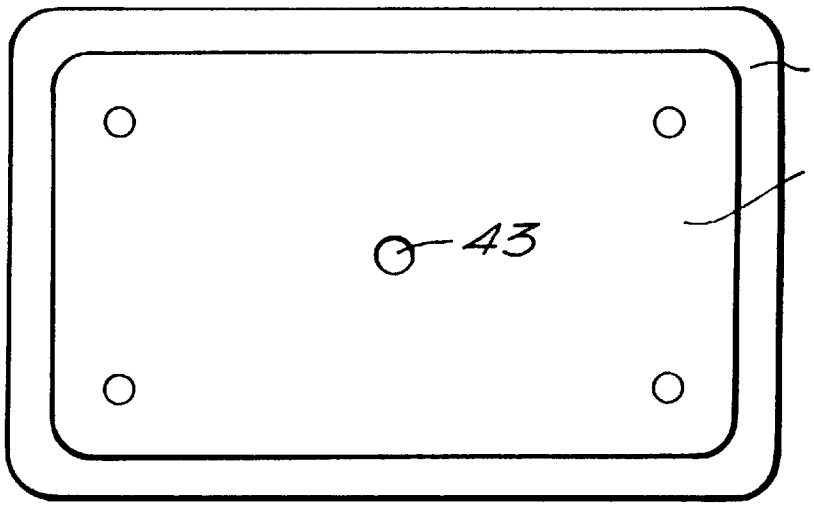
FIG. 6 is a plan view of the underside of the core and surrounding bladder.

The underside view of the aluminium core 40 with its surrounding bladder 41 is shown in FIG. 6.

When the refractory composition has set, the bladder is deflated and the core and bladder removed from the mould, after which the set impact pad may be removed.

Impact pads of the invention have been tested and found to provide improved residence time even over the improved pads of U.S. Pat. No. 5,518,153. This is shown in the accompanying Tables 1 to 7 in which TURBOSTOP™ Standard System relates to impact pads of U.S. Pat. No. 5,518,153 and TURBOSTOP™ Bladder System relates to impact pads of the present invention.

The tests were performed using a 0.3 scale tundish model with the impact pads placed on a 203 mm (8 inch) step with no other flow controls. Two flow rates were used—27.5 litres/min (7.25 G.P.M.) (4 tonnes/min) and 55 litres/min (14.5 G.P.M.) (8 tonnes/min).

These results show a 10.7% increase in minimum residence time for the invention at 27.5 litres/min (7.25 G.P.M.) and 48.8% increase at 55 litres/min (14.5 G.P.M.) The pads of the invention also provided a decrease in mixed grade times of 20.5%.

TABLE 1

TURBOSTOP Standard System vs TURBOSTOP Bladder System

| TEST | TURBOSTOP S 27.5 (7.25) | TURBOSTOP S 55 (14.5) | TURBOSTOP B 27.5 (7.25) | TURBOSTOP B 55 (14.5) |
|---|---|---|---|---|
| Min. Res. | 112 sec | 41 | 124 | 61 |
| Peak Con. | 105.5% | 119.3 | 117 | 102.4 |
| Peak Time | 175 sec | 66 | 191 | 134 |
| Median | 451 sec | 207 | 441 | 235 |
| Trans Time | *** | 205 sec | *** | 163 |

TABLE 2

TURBOSTOP Standard System R.T.D. Study at 27.51/min (7.25 G.P.M.)

| Test | 1 | 2 | 3 | Ave. |
|---|---|---|---|---|
| Min. Res. | 95 sec | 127 | 115 | 112 |
| Peak Con. | 115.5 | 98.4 | 102.7 | 105.5 |
| Peak Time | 105 sec | 215 | 205 | 175 |
| Median | 415 sec | 492 | 447 | 451 |

TABLE 3

TURBOSTOP Bladder System R.T.D. Study at 27.51/min (7.25 G.P.M.)

| Test | 1 | 2 | 3 | Ave. |
|---|---|---|---|---|
| Min. Res. | 132 sec | 122 | 117 | 124 |
| Peak Con. | 107.9% | 119.6 | 123.4 | 117 |
| Peak Time | 267 sec | 145 | 160 | 191 |
| Median | 455 sec | 430 | 437 | 441 |

TABLE 4

TURBOSTOP Standard System R.T.D. Study at 551/min (14.5 G.P.M.)

| Test | 1 | 2 | 3 | Ave. |
|---|---|---|---|---|
| Min. Res. | 37 sec | 42 | 45 | 41 |
| Peak Con. | 138.7% | 106.9 | 112.2 | 119.3 |
| Peak Time | 47 sec | 67 | 85 | 66 |
| Median | 197 sec | 207 | 217 | 207 |

TABLE 5

TURBOSTOP Bladder System R.T.D. Study at 551/min (14.5 G.P.M.)

| Test | 1 | 2 | 3 | Ave. |
|---|---|---|---|---|
| Min. Res. | 57 sec | 62 | 65 | 61 |
| Peak Con. | 100.7% | 111.0 | 95.6 | 102.4 |
| Peak Time | 135 sec | 140 | 127 | 134 |
| Median | 245 sec | 217 | 242 | 235 |

TABLE 6

TURBOSTOP Standard System Transition Study at 551/min (14.5 G.P.M.)

| Test | 1 | 2 | 3 | Ave. |
|---|---|---|---|---|
| 20% | 95 sec | 82 sec | 105 sec | 94 sec |
| 80% | 272 | 290 | 335 | 299 |
| Trans. Time | 117 | 208 | 230 | 205 |

TABLE 7

TURBOSTOP Bladder System Transition Study at 14.5 G.P.M.

| Test | 1 | 2 | 3 | Ave. |
|---|---|---|---|---|
| 20% | 102 sec | 92 sec | 85 sec | 93 sec |
| 80% | 275 | 260 | 232 | 256 |
| Trans. Time | 173 | 168 | 147 | 163 |

We claim:

1. A tundish impact pad (10) comprising a body of refractory material capable of withstanding contact with molten steel in a tundish, the body comprising a base (12) having an impact surface (13), an outer sidewall (14) extending upwardly from the impact surface (13), an annular portion (15) providing a top surface (16) substantially parallel to the impact surface (13) and connected to the sidewall (14) and defining an opening (11) into the pad (10), the lower face (17) of the annular portion (15), the inner face (18) of the sidewall (14) and the upper surface (19) of the base (12) adjacent the sidewall (14) together providing a continuous curved surface, characterised in that the continuous curved surface adjacent its lower end defines a trough (20) around the perimeter of the impact surface (13) of the base (12).

2. A tundish impact pad according to claim 1, characterised in that the sidewall (14) extends continuously around the impact surface (13).

3. A tundish impact pad according to claim 1 characterised in that the opening (11) defined by the annular portion (15) is non-uniform in having a long dimension and a short dimension perpendicular to the long dimension.

4. A tundish impact pad according to claim 1, characterised in that it is formed of a castable refractory composition having an alumina content in the range of about 55 to 85% by weight.

5. A tundish impact pad according to claim 1, characterised in that it is formed of a castable refractory composition having a magnesia content in the range of about 58 to 93% by weight.

6. A method of making a tundish impact pad in which a mould (30) is provided to define a base portion (12) of the pad (10) having an impact surface (13), a sidewall (14) surrounding the base (12) and an annular portion (15) to provide a top surface (16) of the pad (10) parallel to its impact surface (13), characterised in that an annular inflatable bladder (41) is positioned in the mould (30) and is inflated to define a mould cavity having the base portion (12) of the pad above the bladder (41) and the sidewall portion (14) of the pad between the extrior of the bladder (41) and the sidewall (32) of the mould (30), a settable refractory composition is introduced to fill the mould cavity, the composition is set and the bladder (41) is then deflated and removed.

7. A method according to claim 6, characterised in that the bladder (41) is positioned around a mould core (40) and the base (12) of the impact pad (10) is formed above the core (40) with the impact surface (13) being defined by the upper surface of the core (40).

8. A method according to claim 7, characterised in that the mould core comprises a lower core portion (40) having a recess in its upper surface, the recess containing a plate (45) and a length (46) of material attached to the bladder (41) is trapped between the lower core portion (40) and the plate (45).

9. A method according to claim 7, characterised in that the mould core is positioned on a centrally disposed pad (33) on the base (31) of the mould (30) so that the bladder (41) when inflated overhangs the perimeter of the pad (33) and that the mould cavity for the annular top portion (15) of the pad (10) is defined between the sidewalls (32) and base (31) of the mould (30), a portion of the surface of the bladder (41) and the sides of the pad (33).

10. A method according to claim 7, characterised in that the bladder (41) is attached to the core (40) via one or more connectors (44) and inflation gas is passed through passages (43) through the core (40) and via the connector(s) (44) to inflate the bladder (41).

11. A method according to claim 6, characterized in that the bladder (41) is made of rectangular plan form.

12. A method according to claim 7, characterised in that the core (40) has concave edges (42) to embrace a portion of the external circumference of the bladder (41).

13. A method according to claim 9, characterised in that a length (47) of material attached to the bladder (41) is trapped between the lower face of the core (40) and the upper face of the pad (33).

14. An apparatus for the manufacture of a tundish impact pad, the pad (10) having a base (12) having an impact surface (13), a sidewall (14) surrounding the base (12) and an annular portion (15) to provide a top surface (16) of the pad (10) parallel to the impact surface (13), the apparatus comprising a mould (30) having a base (31) and upstanding sidewalls (32), characterised by an annular bladder (41) positionable in the mould (30) and inflatable to define a mould cavity in which the base portion (12) of the pad is above the bladder (41) and the sidewall portion (14) of the pad is between the exterior of the bladder (41) and the sidewalls (32) of the mould (30).

15. An apparatus according to claim 14, characterised by means to introduce a castable refactory composition into the mould cavity.

16. An apparatus according to claim 14, charactersed by a mould core (40) around which the bladder may be positioned so that the base (12) of the impact pad (10) can be formed above the core (40) with its impact surface (13) being defined by the upper surface of the core (40).

17. An apparatus according to claim 14, characterised in that the mould core (40) has concave edges (42) to embrace a portion of the external reference of the bladder (41).

18. An apparatus according to claim 16, characterised in that the upper surface of the core (40) has a recess to contain a plate (45).

19. An apparatus according to claim 16, characterised in that the core (40) contains one or more passages (43) connectable at one end to the bladder (41) via connector(s) (44) and connectable at the other end to a source of inflation gas for the bladder (41).

20. An inflatable bladder for use in the method of claim 6, characterised in that the bladder (41) is annular and has a configuration in plan view which is non-uniform in that it has a long dimension and a short dimension perpendicular to the long dimension.

21. An inflatable bladder according to claim 20, characterised in that the configuration is rectangular or elipsoidal.

22. An inflatable bladder according to claim 20, characterised in that it has two spaced lengths (46) and (47) of material extending around and from its inner periphery whereby it may be secured in the desired position in a mould.

23. An apparatus according to claim 14 characterized in that the bladder (41) is annular and has a configuration in plan view which is non-uniform in that it has a long dimension and a short dimension perpendicular to the long dimension.

* * * * *